US006266984B1

(12) United States Patent
Gasparini

(10) Patent No.: US 6,266,984 B1
(45) Date of Patent: Jul. 31, 2001

(54) METAL SHEET PRESS-BENDING MACHINE

(76) Inventor: Luciano Gasparini, 11 Via Storti, I-31036, Istrana (IT)

( * ) Notice: Subject to any disclaimer, the term of this patent is extended or adjusted under 35 U.S.C. 154(b) by 0 days.

(21) Appl. No.: 09/446,595

(22) PCT Filed: Oct. 16, 1997

(86) PCT No.: PCT/IT97/00250

§ 371 Date: Mar. 27, 2000

§ 102(e) Date: Mar. 27, 2000

(87) PCT Pub. No.: WO98/58753

PCT Pub. Date: Dec. 30, 1998

(30) Foreign Application Priority Data

Jun. 20, 1997 (IT) ..... TV97A0083
Jul. 25, 1997 (IT) ..... TV97A0102

(51) Int. Cl.[7] ..... B21D 5/02
(52) U.S. Cl. ..... 72/31.11; 72/389.3; 72/702
(58) Field of Search ..... 72/31.1, 31.11, 72/389.3, 702

(56) References Cited

U.S. PATENT DOCUMENTS 4,131,008 * 12/1978 Malatto ..... 72/389.3
4,489,586 * 12/1984 Hess ..... 72/389.3
4,640,113 * 2/1987 Dieperink et al. ..... 72/389.3
5,062,283 * 11/1991 Miyagawa ..... 72/389.3
5,584,199 * 12/1996 Sartorio ..... 72/389.3
5,842,366 * 12/1998 Klingel et al. ..... 72/389.3

FOREIGN PATENT DOCUMENTS

19521369 * 12/1996 (DE) .
0166352 * 1/1986 (EP) .

OTHER PUBLICATIONS

Apr. 1990.*

* cited by examiner

*Primary Examiner*—David Jones
(74) *Attorney, Agent, or Firm*—Conley, Rose & Taylon, P.C.

(57) ABSTRACT

A press-bending machine to bend metal sheets, having improved features in the respective press-bending with measuring and control system operating on at least four points of the bending angle, of the type in which the press-bending machine has: an upper vertically reciprocal elongated bending punch; a lower static elongated bending matrix with at least a longitudinal bending groove; feeler means to measure the respective bending movement of the metal sheet in bending inside said bending groove, to control by data process logic unit the bending parameters of bending process in said bending machine, said feeler means operating with at least four bending detection points, characterized in that all said detecting points are conceived in such a way to be divided in two sets of bend detecting points, one to one side and one to the other side and in a symmetrical way divided in number and position respective to the vertical plane passing along the respective sheet bending line corresponding with the bending corner of the resulting bent sheet.

8 Claims, 3 Drawing Sheets

METAL SHEET PRESS-BENDING MACHINE

TECHNICAL FIELD

This invention has for object a press-bending machine having improved features in the respetive press-bending with measuring and control system operating on at least four points of the bending angle. The innovation finds particular even if not exclusive application in the controlled sheet deformation on press-bend working.

BACKGROUND ART

Bending presses are known. They find wide use in the metal and mechanical industry, and in particular in the bending of metal sheets, for example for obtaining some differently shaped longitudinal sections, sometimes with the possibility of being taken up and, each of them, subjected again to a bending-pressing cycle. As a rule, it is possible to notice that a bending cycle consists essentially of the vertical descent of a tool up to touching the underlying metal sheet resting on the bench, in the carrying out of the bend, and then, at the end, in going back (lifting) up to reaching a starting position.

For carrying out the previous phases, the machine is made up of two parts, respectively a dynamic upper one (movable upper part), and a static lower one, making up the underside of the machine placed on the perpendicular of the dynamic part.

Regarding the dynamic part, in the execution of a bending cycle, the movable bending tool (elongated punch), made up of a blade differently shaped, also of the interchangeable type, effects exclusively a vertical to and fro movement, ensured by at least one oleodynamic cylinder, which determines the descent of an upper cross-piece which supports longitudinally said elongated punch, said punch operating towards a lower cross-piece that supports an interchangeable elongated matrix, followed by the eventual stop and lifting in the starting position.

In existing solutions, some drawbacks are noticeable. These, in general, concern the inaccuracy of the bending angle and in any way relate to an objective difficulty of predetermination and measuring of the bending angle. The traditional system provides that, giving a known total height of the matrix and depth of the groove in the matrix bending area, and the thickness of the sheet, the punch lowers to touch the sheet, then to further lower of a prestablished height to reach the required bending angle.

In the machines with numerical control, the punch descent is calculated mathematically on the base of some parameters set by the operator, and consequently, the machine is prearranged for executing the programmed angle. However the result is not always optimal, as such technique, many times leads to obtaining angles with some errors even if limited ones. This happens because of the presence of different factors, for example, the thickness of the sheets which is not constant, where even the incidence of few hundredths of a millimeter negatively influences the working.

For other reasons, because said predetermined theoretic calculation, such system does not offer the possibility of really checking the result, at the moment of bending, with the risk of endangering the productive process.

An additional factor having considerable character, relates to the natural elastic return of the material, which is calculated hypothetically and therefore in so far as it can be reliable, it may get close to the desired result, but it will never be considered as a real data.

Finally, besides the faultiness of the product, it is necessary to consider that the desired result is never attainable at the first bending cycle, that is at the first press-bending, but generally, a second press-bending phase is always necessary that intervenes to correct the first result.

With the aim of solving the problems pointed out, some complex press machines were conceived, which use a bending matrix supplied with an adjustable bottom, allowing to obtain a bending angle more precise than that of the traditional systems.

From a practical point of view, said matrix provides two surfaces coplanar and movable on horizontal plane defining in an intermediate position a longitudinal groove whose bottom may be eventually modified in height.

Such groove determines the momentary bending angle by means of the relative position of both the support surfaces on the side of the groove, which delimit its opening, and the bottom of the same groove.

Also in this hypothesis, however, persists a certain inaccuracy, one of whose causes is ascribable to the phenomenon of the elastic return of the sheet, a condition which occurs at the moment which follows the piece discharge, altering the bending angle originally determined and theoretically calculated.

Consequently, is necessary to proceed at first with some working tests, and, before starting the definitive bending production cycle, to carry out the due corrections on the numerical control, intervening on the pushing action of the punch and eventually on the position of the matrix bottom.

All this, besides requiring the intervention of specialised personnel, involves the machine stop and in conclusion, a considerable loss of useful time unavoidably influencing the relative production costs.

European Patent 340 167 (Hammerle) document, proposes a bending process according to a given nominal angle with the aid of a bending equipment made up of a punch and of a matrix, which is supplied with an adjustable bottom according to the angle to be formed.

The text points out that the process consists in that it provides:

- in a first phase, the adjustment in height of the matrix bottom occurs on the basis of the first angle to be obtained, which is a little wider in respect to the given nominal angle, where the sheet is bent on the basis of this first angle by the lowering of the punch up to the matrix bottom;
- in a second phase, the section is discharged, so that a return of the same in the stretched position occurs;
- in a third phase the measured angle deriving from the returned and stretched section, is compared with the first angle and the position of the matrix bottom is adjusted with a value that corresponds to the nominal angle minus the difference between the angle measured on the released section and the first angle;
- in a fourth phase the bent sheet is completely pressed by the punch again charged against the matrix bottom, which will take a correct position in height.

However even this solution is not free from drawbacks.

First of all, it appears as an extremely complex machine, not flexible and somewhat oversized, which needs a constant and accurate maintenance and setting-up, predominantly feasible by highly specialised personnel.

The consequence is, for the reference market, some high costs, above all related to the purchase and management of the machine itself. From a qualitative view-point, finally, said solution does not allow to obtain a sheet bending with the round corner on the extrados, therefore optimal for the next processing.

And in fact, it can be noticed that in the bending phase, by using a third dynamic point as mechanical element provided on the matrix bottom, the sheet in logic correspondence tends to be deformed, getting flat, practically becoming squashed, even if slightly, mainly in correspondence of the extrados of the bending angle.

A proposal, that can help to solve part of the problems previously pointed out, was put on the market by the Belgian Company LVD with the system named Easy-Form®.

Said system, consists in providing a movable arm, placed on the matrix side, which, supported by two articulations, and in bending phase, places a sensor means in contact with one of two wings of the diverging sheet.

Said sensor means, is coaxially movable in respect to said arm, and provides a measured data to the control logical unit of the machine. In this hypothesis, there are therefore three measuring points for giving parameters to the machine, two of which known, made up by the intersection corners of the plane with the matrix bending groove, and one variable and detectable by the oscillation with following positioning of said movable arm.

However, this is just because of the improper side position of the third point, dynamic, in respect to the matrix for the measuring of the bending angle, that a satisfactory precision is not allowed as, because of the natural characteristics of the material, a data unlike and different from the real data objectively concerning the bending angle would result. =p Finalised to radically solving the problems of the solutions previously described, the applicant with the Italian Patent Application TV97A000039 (Gasparini), proposes a press-bending process of the metal sheet by a direct measuring system, in which the following is provided:

- the advancement of the metal sheet on the working bench, up to intersecting the vertical axis plane of the upper punch supported by an upper cross-piece, towards the underlying matrix supported by a lower cross-piece; and in which on the back of the sheet foil feel a feeler means, passing into the matrix and connecting each with a respective measuring group, each of which communicates with a data processing logical unit that controls said press-bending machine;
- therefore, after carrying out the descent phase of the punch, towards the underlying matrix, and then press-bending the sheet and determines a corresponding displacement along the vertical axis of said feeler means, which, being in co-operation with reading means of a corresponding measuring group, communicate to the data process unit the data relative to the bending stroke;
- at the end, in proceeding with the reascent of the punch, by carrying out at the same time the reset of said feeler means to their original condition;
- and again in which, detecting in the first phase through said feeler means, permanently in contact with the sheet foil, a bending angle different in respect to the preset nominal one, said data process unit ensures the consent to the press-bending machine, not discharging the product so obtained, to carry out at least a second descent phase of the punch, towards the underlying matrix up to passing again on the same bending angle, to then proceed with the discharging of the product.

In relation to said process, it is finally an opinion of the applicant, that the working and above all the measuring phase of the bending angle may be further optimized, above all with regard to the precision and the reading times of the bending angle obtained, not excluding the possibility of intervening for the correction of the elastic return of an already pressed-bent sheet.

A recent system for the measuring of the bending angle characterised by the trade-mark ACB®, and disclosed in DE 195 21 369, was proposed by the Firm TRUMPF and concerned a product named TrumaBend series V. It, in practice, consists in providing on the inside of the upper bending tool (punch), two feeler discs, with different diameters. During the bending process the discs are self-centred measuring four contact points on the internal side of the bend, and consequently, on the basis of the distance of the centres of the discs, the system allows to calculate the effective angle, said discs being changed with independtly movable pins placed on either side of the punch.

The main drawback, which can be ascribed to the above mentioned solution, consists essentially of the fact that it is not possible to intervene on the bendings with such measuring system, in which the sheet, relatively to the angle obtainable on the internal side of the bending, is wider than 90° to 10°.

Said system, additionally, obliges to maintain the sheet edges somewhat wide, reducing the use possibilities of the different matrixes, with a consequent lower flexibility of the press-bending machine.

Finally, said system predetermines the bending angle by means of some calibration matrixes, and consequently, on one side involves a limitation of the bending measuring and on the other does not allow a rapid obtainment of the bending desired, above all in consideration of the fact that it needs a complex setting. U.S. Pat. No. 4,489,586 discloses a bending feeler means passing through the respective punch. U.S. Pat. No. 4,131,008 discloses a "V" shaped axial feeler means passing through the V die matrix.

In relation to the two latter techniques for the measuring of the bending angle, it is the opinion of the applicant, that the working and above all the measuring phase of the bending angle may be further optimised, above all with regard to the precision and the reading times of the bending angle obtained, not excluding the possibility of intervening for the correction of the elastic return of an already pressed-bent sheet.

These and other problems are solved with this innovation according to the characteristics as in the included claims, by a press-bending machine to bend metal sheets, with measuring and control system of the bending angle, of the type in which the press-bending machine has:

- an upper vertically reciprocable elongated bending punch;
- a lower static elongated bending matrix with al least a longitudinbal bending groove;
- feeler means, having bending detecting points, to measure the respective bending movement of the metal sheet in bending, on said bending groove, to control and command by data process logic unit the bending parameters of bending process in said bending machine, wherein all said bending detecting points are conceived in such a way to be divided by an immaginary vertical plane passing on the bending corner line of the bending metal sheet, in two sets of bending detecting points, one set of detecting points to one side and one set of detecting points to the other side, wherein said bending detecting points are realized by a vertically elastically movable feeler means, moving on the vertical plane crossing the corner of the "V" groove, independently of respective bending punch movement, characterized in that: along said bending groove of said matrix, said feeler means is made up of a couple of forks mutually interacting, the one inside or adjacent in respect to the other, in such a way that the median axis of both said forks coinciding with the axis of said punch, and in which said forks are elastically yielding and are downwardly connected with a relative position transducer communicating with a data process logical unit that manages said pressing-bending machine.

Advantageously the feeler is substantially a fork and a bending operation is as follows:

the advancement on the working bench of at least one metal sheet, up to intersecting the descent vertical axial plane of said punch supported by a reciprocally movable upper cross-piece, toward the underlying matrix supported by a lower cross-piece; and in which on the sheet rested on the matrix, feel at least one feeler means made up of said feeler measuring fork interacting with said position transducer, communicating with a data processing logical unit that controls said press-bending machine;

therefore, in carrying out a first descent phase of the measuring punch supporting upper cross-piece, towards the underlying matrix supported by a lower cross-piece, pressing-bending the sheet foil and determining a corresponding displacement along the vertical axis of said feeler means, which, interacting with said position transducer, communicates to said data process unit the data relative to the bending stroke;

at the end, in the carrying out of at least one partial re-ascent of the punch, carrying out at the same time the reset of the feeler means in an original starting condition;

and again in which, detecting in the first phase through said feeler means, a bending angle different in respect to the preset nominal one, said processing unit ensures the consent to the press-bending machine, not discharging the product so obtained, for carrying out at least one second descent phase of the punch, towards the underlying matrix up to resting again on the same bending angle, for then proceeding with the product discharging.

In one solution the use of a feeler measuring fork realizes substantially two feeling angled points wherein the other two angle points is realized in the borders (corners) of the elongated groove of the matrix.

Better performance is mainly due to the improved measuring system of the bending angle, which besides being extremely precise, is always supplied in real time, allowing to intervene in a determinant way for the error correction, up to obtaining the nominal bending angle with the due precision.

In this way, the reading during the bending is more precise, thus avoiding bending errors.

Using the fork-like shaped feeler means, the bending angle is measured, not as if this were an ideal geometric figure defined by three points, but viceversa considering the real inclination of the two specular planes each interested by two measuring points one of which is known and the other is variable, definitely overcoming the errors caused by the thickness of the sheet, by the material composition, and of the thinning caused by the sheet stretching in correspondence of the edge.

The consequence is that, once the machine is set for the obtainment of a certain bending angle, it is possible to bend another sheet of any material and thickness, provided that it is compatible with the width of the bending groove, without modifying the set programming and without carrying out tests.

It must be additionally considered that the use of such feeler means allows a radical simplification of the press-bending machine, with, on one side an important reduction of the manufacturing costs and on the other a fair containing of the encumbrances of the respective devices.

As a consequence thereof, it requires a minimum maintenance, easily possible by suitable personnel and with short stops of the productive cycle.

This system has the further advantage of simplifying the execution of the control software as this means a measuring of only a linear displacement of the feeler fork. Finally, the system for maintaining the pressed-bent sheet in place is particularly interesting and innovative, for allowing the execution of a second bending phase, suitable to correct the elastic return of the sheet measured after a first bending phase.

Said system, substantially, avoids the pressed-bent sheet, from being subjected to displacements, also accidental, in respect to the matrix and this until the punch has not again touched the bending groove for the correction of the error detected in respect to the nominal data of the preset angle.

Advantageously:

on the back of the metal sheet rested on the matrix, permanently feel at least one feeler means, provided along the corner axis of the bending groove of said matrix, said feeler means being made up of a couple of forks mutually interacting, the one inside or adjacent in respect to the other, in such a way that the median axis of both the forks coincides with the axis of the punch, and in which said elastically yielding forks are connected with a relative position transducer communicating with a data process logical unit that manages said press-bending machine; With this solution the measuring of the bending angle is made possible, on four dynamic measuring points or bending detecting points, with the maximum precision possible without any limitation relative to the angle to be obtained.

This solution does not need the execution of a perfect groove in the matrix, as the aforesaid measuring system is independent of any reference on the same.

The measuring system is independent from the eventual elastic deformation of the matrix, in the bending execution phase.

The bending time can be reduced, accelerating the whole productive process. Such result is more evidently considered the most effective measuring system of the bending angle, which other than being extremely precise, always provides the data in real time, allowing to intervene in a resolutory way for the error correction, up to obtainin, with due precision, the nominal bending angle.

As the reading of the angle during the bending occurs on the same side of the sheet, in the first case on the lower surface and in the second case in the upper surface of the sheet, errors due to the change of thickness of the sheet are avoided.

Additionally, it is found that by using one of the above mentioned feeler means, the bending angle is measured considering the real inclination of the two specular planes of the sheet, each concerned, on the intrados or on the extrados by the couples of measuring points, overcoming in a definitive way the errors caused by other factors eg yielding (kind of the material), and by the thinning caused by the stretching in correspondence of the edge.

The result is that, once set the machine for the obtainment of a certain bending angle, it is possible to bend another sheet of any material and thickness, provided that it is compatible with the width of the bending matrix groove and respective punch, without modifying the programming set and without carrying out tests and this also with small bendings.

These, and other advantages will appear from the following description of same solutions with the aid of schematic drawings, whose details are not to be considered as limitative but only illustrative.

FIG. 3, shows a view in detail of one of the phases of the sheet bending process, seen in correspondence of the punch which rests on the matrix, determining the displacement, along the vertical axis, of a measuring device including a feeler means consisting of a double fork.

FIG. 4, shows a view of a subsequent phase of the process for the working of the sheet foil found in FIG. 11, seen in correspondence to the punch that passes on the matrix, determining the displacement, along the vertical axis, of a measuring device including feeler means made up of a double fork.

Figure 1:
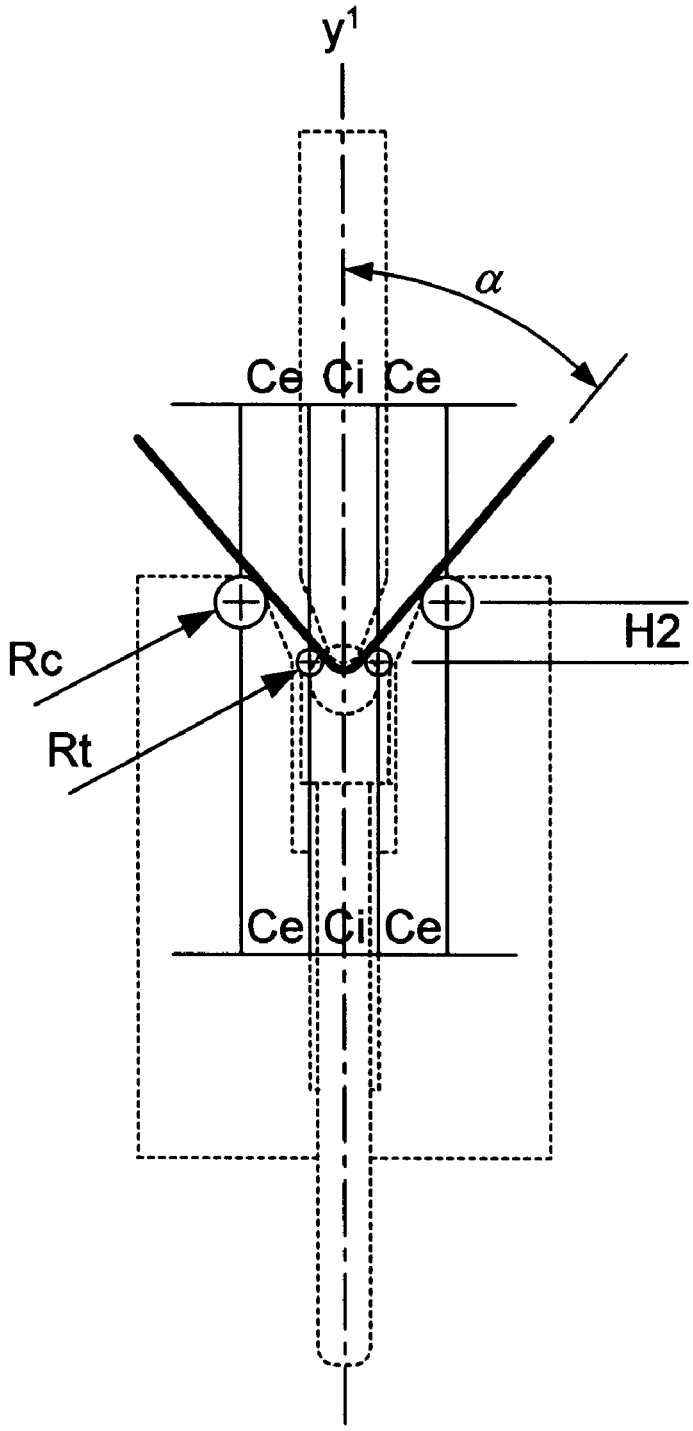
FIG. 1, shows a view, in detail and with reference to the previous Figure, of the four bend detecting points detected by the measuring device, from which are obtained respective data necessary in the determining of the actual bending angle.
Figure 2:
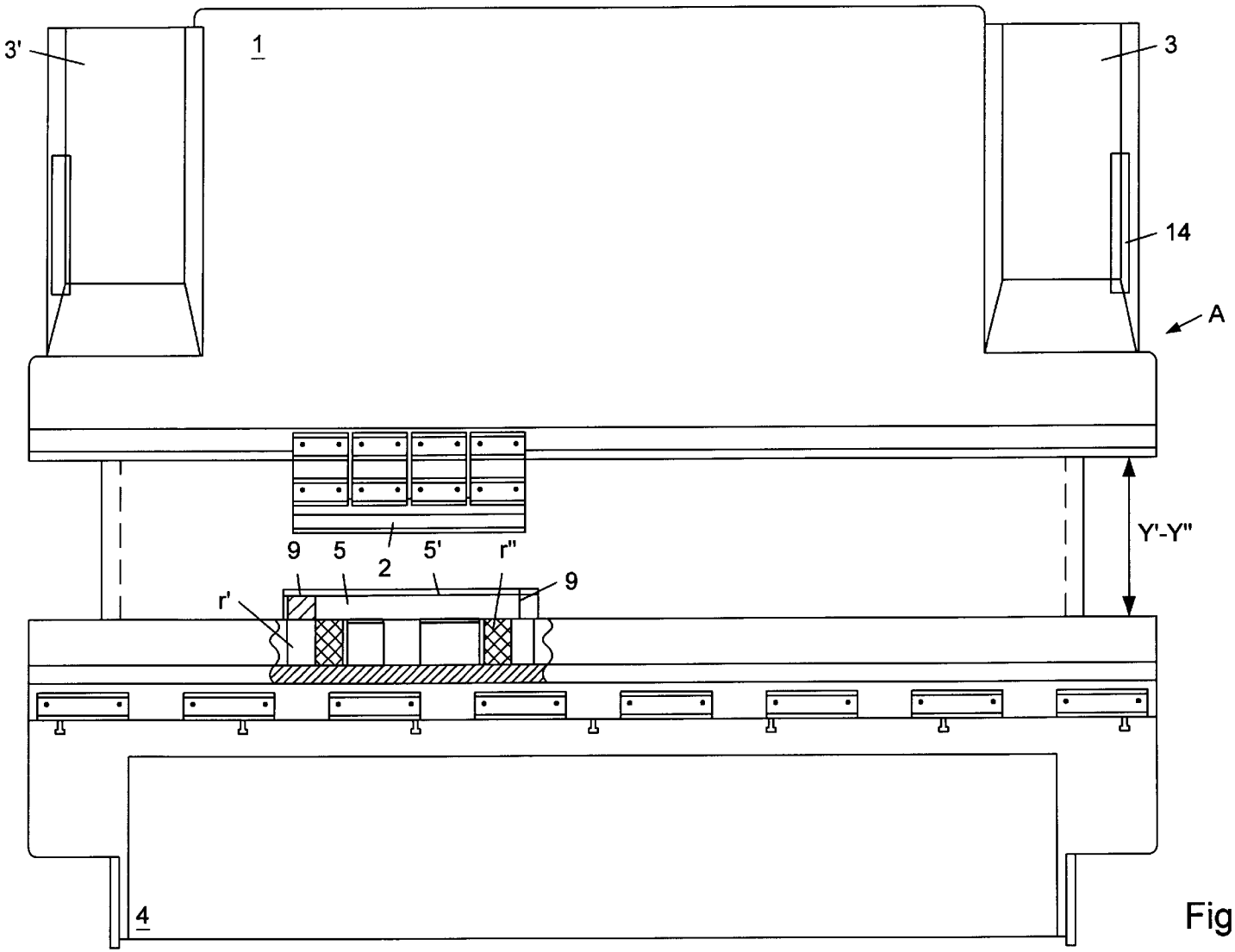
FIG. 2, shows a front view of a press-bending machine, in which, relative to the lower cross-piece, some devices for the bending angle measuring are pointed out.
Figure 3:
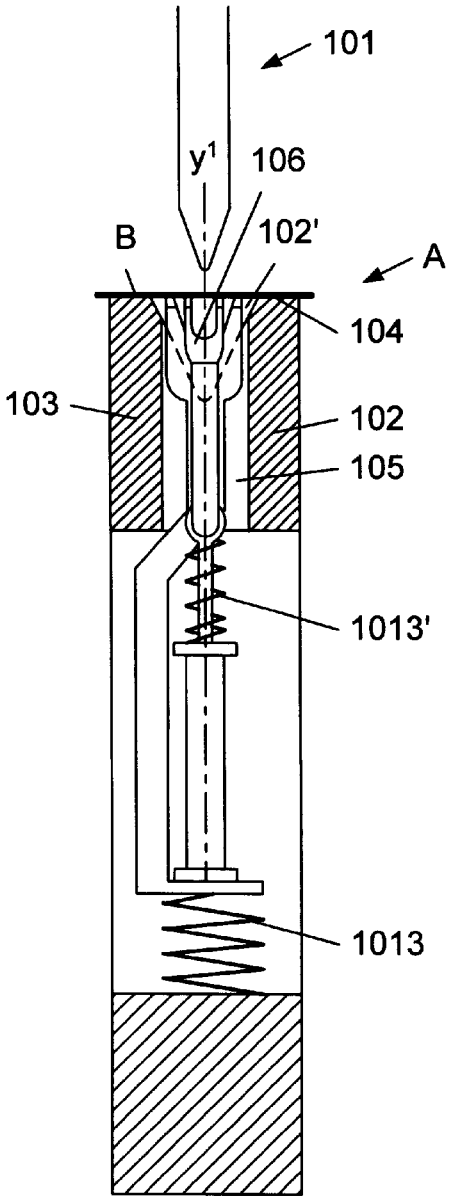
FIGS. 3 and 4 show the solution of the fork feeler means using a double fork as for this invention in the two main phases, before bending the sheet and after bending it.
Figure 4:
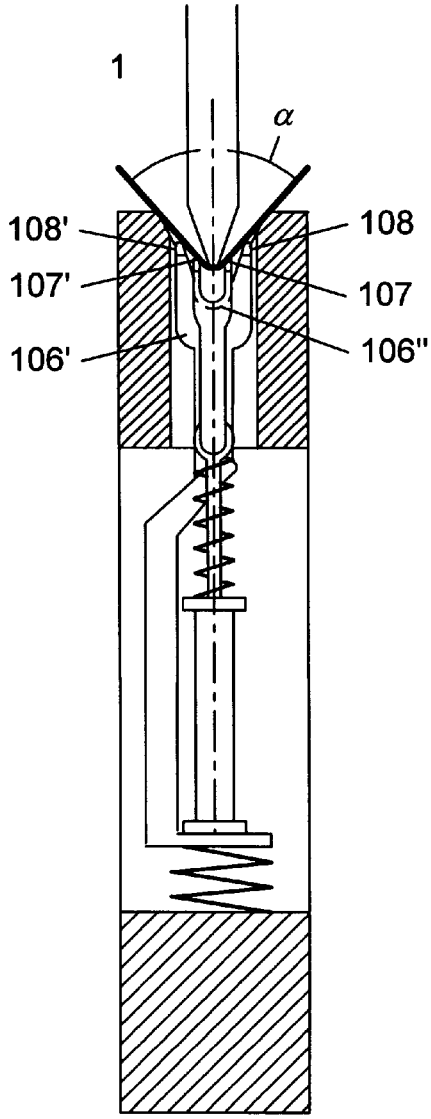

Considering the FIGS. 1 to 2, it can be seen that a press-bending machine (A), is made up of an upper and lower part, the first essentially dynamic in respect to the second one, static.

Of the first one, is part an upper cross-piece (1), vertically movable along the vertical axis (Y'–Y") in respect to the frame of the pressing-bending machine, on whose lower end is provided associated, longitudinally, a tool of the interchangeable type, making up the punch (2).

The press-bending machine (A), provides at the ends, a cylinder means (3, 3') for each side, which determines the descent and lifting movement along the axis (Y'–Y"), of the upper cross-piece (1) towards the underlying lower cross-piece (4), which supports a matrix (5) also of the interchangeable type.

Said matrix (5) has longitudinally, at least one bending groove (5') that determines the bending angle "a" of a sheet foil (B) subjected to a working cycle.

In this case, along the longitudinal groove (5') of a matrix (5), is provided at least one measuring area, in this case two of them (r'–r"), placed at the ends of the same one, or near to the sheet ends (B), and more in detail a right one and a left one (r'–r").

On the top of said groove (5'), the walls, obtained by the intersection of the tilted planes with the horizontal plane of the matrix (5), two opposite corners, realizing a first couple of said angled bend-detecting points (6, 7) are obtained, on which corners the sheet (B) in bending phase works.

The groove (5'), provides on the bottom, logically corresponding to each of the two areas (r'–r"), axial vertical holes (105), on whose inside it is vertically movable, following a stroke ($y^1$), a relative nail fork-like feeler (9-106: 108–108': "Rc"). Said feeler (9-106), in correspondence to the upper end, is provided with a head (107–107': "Rt") both with a fork-like or even with "U"-like shape, suitable to touch with the two angled points and permanently, the back of the sheet (B), while on the other side said feeler (9-106), interacts with a relative measuring group which transmits the data to a data logic process unit of the information thus acquired.

In this case, the measuring system of the bending angle "α", that concerns at least the two end areas (r'–r") uses substantially four measuring points for each of them, respectively, two static ones (Rc FIG. 1) which correspond to the centre of the curvature radius of the corners of the groove (5'-102') of the matrix (5), and two dynamic ones (Rt FIG. 1), as feeler fork points (107–107'; 108–108') symmetricaly placed one to one side and one to the other side of the bending corner axial line; both operating on the back of the sheet (B).

In this case, the two dynamic points (Rt), will be diametrically opposed in respect to the bending axis (Y'–Y"), where the horizontal distance between the centres (Rc) and (Rt) is not always constant (Ce), whereas the distance (Ci) between said two dinamic feeler points (Rt) is constant. In substance, we have four feeling points (2×Rc+2×Rt) of which two static detecting points (Rc) and two dynamic detecting points (Rt) that integrated in a movably dynamic feeler device (9) costitutes two feeler points (Rt), the total remaining four detecting points. Both couples of points beng divided symmetrically in position and number to one side and to the other side of said vertical axial plane passing on the bending corner line (y1) The detecting points result symmetric respect to the bending axis (Y'–Y"). While the position of the static detecting points (Rc) is known to the data processing unit of the machine (A), the exact position of dynamic feeling points of feeler points (Rt), is detected by said feeler fork-like shaped (9-106), that is maintained pressed against the lower surface of the sheet (B), with the feeler points one on one side and the other to the other side of the bending corner line (Y1 axis). Therefore, knowing the displacement ($H_2$) between the static couple (Rc) and the dynamic couple (Rt) it is possible to calculate the bending angle "a" as it corresponds exactly to the tangent of the radii (Rc) and (Rt).

In a working cycle, when the sheet (B) is placed over the matrix (5), the four bend detection points (Rc, Rt) of each area (r'–r"), are placed perfectly aligned and coplanar.

In this condition, by means of the optical transducer group, the processing unit feels the position of the nail-like feeler (9-106), and considers it as a "0" value (Index).

On the practical side, it is preferable that the data process unit provides that the feeler means (9-106) is put in position, touching the back surface of the sheet (B). By carrying out the bending, the sheet (B), curves penetrating toward the groove (5'–102'), pushing consequently downwards also the fork-nail-like feeler (9-106), whose fork-like shaped ends (107–107'; 108–108') remains in contact with the back of the sheet (B). Consequently, the program of the processing unit, will have to calculate mathematically, relating to the bending angle, the stroke (Y'–Y") of the descent of the punch (2-101), in function of the fixed distances, measurable between the fork-like shaped ends (107–107': "Rt"; 108–108': "Rc") in contact with the sheet (B), the relative couple of points (Rt, Rc), inside the matrix groove corners (102'), thus establishing the required bending angle parameters.

In this way, it is obtained that the stroke (Y'–Y') of the descent of the punch (2), is the same stroke ($y^1$) detected by the feeler ensemble (9-106), which, is read by the corresponding transducer.

More in detail, the displacement (Y'–Y') of the punch (9) is checked, by a first series optical lines up to its contact with the sheet (B), and then the movement control is carried out by the said optical lines of a measuring devices of the bending angle.

Initially, in a bending cycle, the upper cross-piece (1) of the pressing machine (A), descends at high speed carrying the punch (2-101) toward the matrix (5-103).

Such displacement is electronically controlled, thanks to two linear transducers (14), placed to the sides of the press machine (A).

Some millimeters from the sheet (B), the punch (2-101), slows and passes to the low speed up to touching the surface of the sheet (B).

It is at this moment that the reading related to the stroke of the punch (2-101), is given in charge to the transducers placed on the bench, and in fact, it is the sheet (B) pressed by the punch (2-101), that pushes the feelers (9-106), that start the reading mechanisms.

Once an eventual error between the bending angle "a" and the nominal angle is detected, the machine is pre-set for a subsequent and definitive bending cycle, which, without discharging the product (B), will be executed with correction parameters compared and obtained by the reading and processing of data collected in the previous phase.

The press-bending machine (A), can include a punch (2-101) suitable to ease the keeping in position of the sheet (B) during the bending phase, following a first one, for the removing of the bending angle difference noticeable because of the elastic return of the same.

In particular in FIGS. 11, 12, that show said pressing-bending sensing device activated by the sheet B pushed down by said punch (2-101).

The second one lower part of the press (4) includes an elongated matrix (9-102) that has longitudinally, at least one longitudinal bending groove (102') that determines the bending angle "α" of the metal sheet (B) subjected to a bending cycle.

In this case, along the longitudinal bending groove (102'), at least one measuring area, of said bending angle "α" is provided, for example two of them, placed at the ends of the elongated bending groove (102'), or near to the sheet ends (B).

In said matrix, on the top of said elongated bending groove (102'), the corners obtained by the intersection of the tilted planes with the horizontal plane of the elongated matrix (102) realizes two symmetrical opposite detecting points (103, 104), on which works the sheet back (B) in bending phase.

The bending groove (102'), provides on the bottom, corresponding to each of the two detecting areas, holes (105), on whose inside a relative feeler (106) is vertically movable following a stroke ($y^1$), said feeler being realized as an "Y" shape.

Said fork-like shaped feeler means (106), is substantially made up of two Y-rods, whose upper ends make up respective fork (106', 106"), Y-like or U-like shaped, one placed on the inside or aside in respect to the other, having a different distance between centres and between the relative bend detecting points (107–107'; 108–108').

More in detail, the fork (106') has a distance between centers between the respective substantial points (107, 107') wider than that of the fork (106"), whose substantial points (108, 108') define a distance between centers shorter than the previous one.

In this case, it is found that the median axis passing through said forks (106', 106") corresponds to the axis (y1) of the stroke of the punch (101).

With regard to the lower ends of the rods including on the upper part two forks (106', 106"), they are engaged with corresponding elastically yielding means (1013, 1013'), in this case made up of compression helical springs, and each engaged with a relative position transducer group.

Purpose of the position transducer group is that of communicating with a data process logical unit of the press-bending machine, giving the data relative to the different stroke from each single fork (106', 106"), carried out as a consequence of the pressure perpendicularly exerted by the elongated punch (101).

In this way, two specular planes can be detected, corresponding to the back (lower surface) of the bent sheet (B), comparing the difference in height found between the respective substantial points (107, 108) and (107', 108').

What is claimed is:

1. A press-bending machine for bending a metal sheet comprising:

a bending punch;

a bending matrix comprising a longitudinal bending groove;

a feeler coupled to the bending groove, the feeler comprising bending detecting points, wherein the bending detecting points are configured to measure the respective bending movement of the metal sheet during bending, wherein the bending detecting points comprise two or more forks, and wherein the forks are positioned in such a way that the median axis of the forks coincides with the median axis of said punch, and at least one relative position transducer coupled at least one of the bending detecting points, the relative position transducer being configured to determine the bending angle of the metal sheet during use.

2. The press-bending machine of claim 1 wherein the bending detecting points comprise a first fork and a second fork, each of the forks comprising a pair of arms, wherein the distance between the arms of the first fork is different than the distance between the arms of the second fork, and wherein the first fork is positioned within the second fork such that the arms of the first and second forks are coplanar.

3. The press-bending machine of claim 2 wherein the plane defined by the arms of the first and second forks is the same as the median axis of the punch.

4. The press-bending machine of claim 1, wherein the forks are coupled to the relative position transducer.

5. The press-bending machine of claim 1, wherein the forks are coupled to the relative position transducer by an elastic yielding component, and wherein the forks are vertically elastically movable.

6. The press-bending machine of claim 1, wherein the feeler comprises two sets of bending detecting points oriented on opposite sides of the bending matrix.

7. The press bending machine of claim 1, wherein the bending punch is coupled to at least one linear transducer, wherein the linear transducer is configured to control the vertical displacement of the bending punch.

8. The press bending machine of claim 1, further comprising a data process logical unit, wherein the data process logical unit is configured to control the bending parameters of the press bending machine during use, wherein the data process logical unit is coupled to the relative position transducer.

* * * * *